US006676063B2

(12) United States Patent
Gambini

(10) Patent No.: US 6,676,063 B2
(45) Date of Patent: Jan. 13, 2004

(54) RE-REELING DEVICE FOR FORMING A ROLL OF PAPER IN A RE-REELING MACHINE

(76) Inventor: Giovanni Gambini, Via A. Omodeo 7, Pisa (IT)

( * ) Notice: Subject to any disclaimer, the term of this patent is extended or adjusted under 35 U.S.C. 154(b) by 1 day.

(21) Appl. No.: 10/032,253

(22) Filed: Dec. 21, 2001

(65) Prior Publication Data

US 2002/0079402 A1 Jun. 27, 2002

(30) Foreign Application Priority Data

Dec. 27, 2000 (IT) ..... MI20000719 U

(51) Int. Cl.[7] ..... B65H 35/10

(52) U.S. Cl. ..... 242/521; 242/533; 242/541; 242/542

(58) Field of Search ..... 242/521, 542, 242/542.1, 542.2, 541, 533, 533.1, 533.2, 541.2, 542.4, 532.2

(56) References Cited

U.S. PATENT DOCUMENTS 3,123,315 A * 3/1964 Couzens ..... 242/532.3
4,327,877 A * 5/1982 Perini ..... 242/521
4,909,452 A * 3/1990 Hertel et al. ..... 242/521
5,104,055 A * 4/1992 Buxton ..... 242/521
5,370,335 A * 12/1994 Vigneau ..... 242/542.1
5,542,622 A * 8/1996 Biagiotti ..... 242/521
5,603,467 A * 2/1997 Perini et al. ..... 242/521
5,769,352 A * 6/1998 Biagiotti ..... 242/521
5,979,818 A 11/1999 Perini et al.
6,056,229 A * 5/2000 Blume et al. ..... 242/521

FOREIGN PATENT DOCUMENTS

EP 0 524 158 1/1993
EP 0 853 060 7/1998

OTHER PUBLICATIONS

EP Search Report.

* cited by examiner

*Primary Examiner*—William A. Rivera
(74) *Attorney, Agent, or Firm*—Hedman & Costigan, P.C.

(57) ABSTRACT

A re-reeling device for forming a roll of paper in a re-reeling machine comprising, on a frame, three rollers (16, 17, 18) having mutually parallel axes that are perpendicular to the direction of feed of the paper (11), in which two winding rollers, a bottom one (17) and a top one (16), supported on the frame, co-operate with a third roller (18) that maintains a certain pressure on a roll of paper or log being formed, where the third roller (18) is carried by a pair of arms (22) which can oscillate with respect to the frame, the paper (11) that is being wound passing on one of the two rollers, and the finished roll or log (19) coming out of an outlet aperture or gap (30) identified between the bottom roller and the third roller, the cores (12) for said rolls being fed, one after another, by a pusher (15) and being introduced into a calibrated channel (24) made underneath the top roller (16).

7 Claims, 2 Drawing Sheets

RE-REELING DEVICE FOR FORMING A ROLL OF PAPER IN A RE-REELING MACHINE

The present application claims priority to Italian Patent Application Serial No. MI 2000U 000719, filed Dec. 27, 2000.

BACKGROUND OF THE INVENTION

The present invention relates to a re-reeling device for forming a roll of paper in a re-reeling machine.

It is known that in machines or assemblies for winding paper for domestic use, in particular paper subsequently to be used as toilet paper, wipes, serviettes, handkerchiefs and the like, there are provided elements that guide the incoming paper and control proper winding thereof onto a core to produce a finished roll referred to as "log".

It is likewise known that such machines, known as re-reeling machines, usually have two winding rollers and a third pressure roller. It is evident that the two former rollers bring about winding of the paper into a roll, which progressively grows in diameter, whilst the third roller, in addition to co-operating in this winding operation, maintains a certain pressure on the roll or log to make sure that it is wound in a compacted way.

In general, the two rollers have a position that is fixed with respect to the frame and support the log, drawing along the paper, whilst the third roller, acting as pressure roller, exerts pressure on the log being formed and hence determines the diameter of the finished product.

In order to do so, the third roller, or "pressure roller", is supported at opposite ends of at least one pair of arms that are pivoted to the frame. The third roller can thus oscillate according to a curved direction about the pivoting axis of the arms, and the pressure exerted thereon can be controlled by means of a sensor.

In general, there exist problems of feeding of the internal core of the roll into the machine, as well as problems of separation of the finished roll and positioning of the leading end of the incoming paper on the new core.

For example, in the Italian patent No. 1 262 046, a special arrangement is envisaged of a means for interrupting the ribbon-like material that co-operates with means for feeding along a channel, between a position of insertion of a new core and a groove or outlet gap for the core between the three rollers so as to enable the roll of paper to be wound.

The arrangement of this means for interrupting passage of the ribbon-like material involves a somewhat complicated synchronization between the parts and does not enable the re-reeling operation to be accelerated.

SUMMARY OF THE INVENTION

A purpose of the present invention is thus to provide a re-reeling device for forming a roll of paper in a re-reeling machine which will overcome the problems referred to above and which can operate in an optimal way even in the absence of the interruption means mentioned previously.

Another purpose of the present invention is to provide a device that will be able to overcome the operating problems of synchronization between the said interruption means and the acceleration of the pressure roller.

Yet a further purpose of the invention is that of providing a device which, whilst solving the problems referred to above, is at the same time able to reduce squeezing of the outgoing finished roll or log to a minimum.

These purposes according to the present invention are achieved by providing a re-reeling device for forming a roll of paper in a re-reeling machine comprising, on a frame, three rollers (16, 17, 18) having mutually parallel axes that are perpendicular to the direction of feed of paper (11), wherein two winding rollers, a bottom winding roller (17) and a top winding roller (16), supported on said frame, co-operate with a pressure inducing roller (18) which maintains pressure on a roll of paper or log being formed, said pressure roller (18) supported by a pair of arms (22) which oscillate with respect to said frame, wherein cores (12), for said rolls, being fed in succession by pusher assembly (13), said cores (12) being introduced into a calibrated channel (24) located underneath said top winding roller (16), said paper (11) being wound on said top winding roller (16) and onto said cores (12), said finished roll or log (19) exiting an outlet aperture or gap between said bottom winding roller (17) and said pressure inducing roller (18) further comprising a deviating roller (28) abutting said top winding roller (16), said deviating roller (28) maintaining said paper (11) stretched, thereby preventing said paper (11) from moving backwards, said paper (11) being torn by an acceleration of said pressure roller (18) followed by attachment of said paper (11) to a second core (12) passing through said calibrated channel (24).

Further, more detailed, characteristics are presented in the subsequent claims.

BRIEF DESCRIPTION OF THE DRAWINGS

The characteristics and advantages of a re-reeling device for forming a roll of paper in a re-reeling machine will emerge more clearly from the ensuing description provided by way of non-limiting example, with reference to the attached schematic drawings, in which.

DETAILED DESCRIPTION OF THE INVENTION

Figure 1:
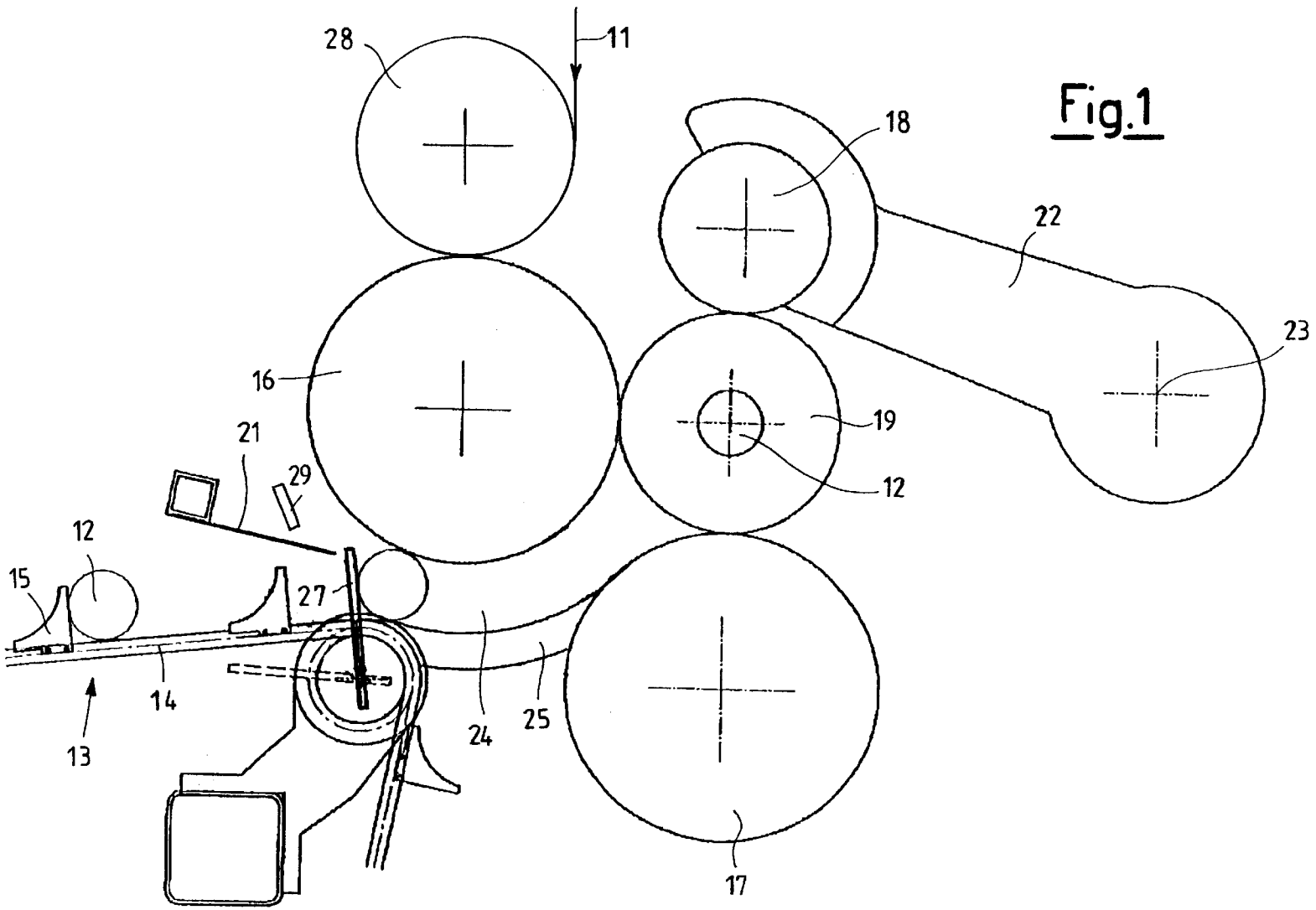
FIG. 1 is a schematic side elevation view of the re-reeling device for forming a roll of paper in a re-reeling machine built according to the present invention.

With reference to the figures referred to above, there is shown a central part of a machine for winding paper 11, in particular paper to be used as toilet paper, wipes, serviettes, handkerchiefs and the like, in which there is set the re-reeling device for forming a roll of paper in a re-reeling machine according to the present invention. In general, the paper 11 that is fed in is paper made up of one or more combined ribbons, once the latter have been unrolled from respective rolls (not shown).

In particular, the paper in the form of a ribbon 11, which comes off a large roll (not shown), must be wound onto a central tubular core 12, the cores 12 being fed in one after another by means of a special pusher assembly 13.

In fact, the pusher assembly 13 comprises, for example, chains 14, which are parallel to one another (only one of these is shown in the figure) and on which pushers 15 are arranged, which are set at a distance apart from one another and pick up the cores from a magazine (not shown).

The said pusher assembly 13, which carries the tubular cores 12, is set facing an arrangement of three rollers 16, 17 and 18, which guide the incoming continuous ribbon of paper 11 and control it so that it winds properly onto the aforesaid core 12 to form a finished roll of a given size, commonly referred to as "log" and designated by 19.

It can be immediately noted from the figure that the three rollers 16, 17, and 18 have mutually parallel axes, which are perpendicular to the direction of feed of the paper 11. Of the aforesaid three rollers two are for winding, a bottom one 17 and a top one 16, and these both co-operate with the third roller 18.

The rollers 16 and 17, which rotate fixed with respect to a frame of the machine, form between them an intake aperture or gap 20. This intake gap 20 is used for receiving the aforesaid core 12, which is carried by the pusher assembly 13, and, in order to block the core 12 in this position, there is provided a compliant blocking element 21. In addition, it is also possible to provide a dispenser element 29 for dispensing adhesive.

The third roller 18, which, as has been said, co-operates with the two rollers 16 and 17 for winding the paper 11, also maintains a certain pressure on the roll or log being formed, to ensure proper winding of the paper. The said roller 18, known as "pressure roller", is supported at opposite ends of at least one pair of arms 22 (only one of these arms being represented in the figure), which are pivoted in 23 to the frame. The third roller 18 is thus able to oscillate about the pivoting axis 23 of the arms and undergoes a control of the pressure that acts thereon by means of a sensor or similar element (not shown).

Furthermore, an outlet aperture or gap 30 is identified, provided between the bottom roller 17 and the third roller, or pressure roller, 18.

According to the present invention, the cores 12, which pass through the intake gap 20, identified between the top roller 16 and the bottom roller 17, are inserted into a calibrated channel 24 that is defined by curved elements 25, set side by side (only one of these being illustrated in the figure), designed to be inserted at least partially, by means of their ends, within channels or grooves 26 made in the bottom roller 17. The bottom roller 17 may in any case also be smooth, and the said curved elements in this case rest on the surface thereof.

As has been said, the channel 24 is calibrated, it being similar in size to the outer diameter of the core 12.

In addition, a second pusher 27 is provided, of a rotating or oscillating type, which co-operates in inserting the core 12, possibly provided with adhesive, within the channel 24.

The interference between the core 12 and the paper 11 wound on the top roller 16 above the channel 24 enables the paper, once the pressure roller 18 has accelerated and torn the trailing end of a finished roll 19, to bring about winding of the leading end of the paper 11 directly. This means that as soon as the acceleration of the pressure roller 18 has torn the trailing end of a finished roll 19, a new core 12 is inserted into the calibrated channel 24. This new core 12, which may possibly be, but is not necessarily, provided with a line of adhesive on a generatrix of its surface, is inserted into the calibrated channel 24, as a result of its sliding on the curved elements 25 and also as a result of the action of the second rotating or oscillating pusher 27.

FIG. 1 shows a first step in which the three rollers 16, 17 and 18 support an almost finished roll, whilst at the intake gap 20 there is set a new core 12 that is ready to be introduced, also with the possible aid of the second oscillating pusher 27, which brings about yielding of the compliant blocking element 21, thus releasing the core 12.

Acceleration of the pressure roller 18 brings about acceleration and tearing of the trailing end of the finished roll 19. Then the new core 12 enters the channel 24, the said core being supported by the curved elements 25.

The calibrated dimensions of the channel 24 enable rotation of the core 12 and adhesion of the leading end of the paper 11, when this reaches the top roller 16, on the core itself, the said adhesion possibly being improved also thanks to the adhesive.

There may possibly be provided another deviator roller 28, located above the top roller 16, which keeps the paper 11 stretched so that it cannot return backwards when it is torn by the pressure roller 18.

Figure 2:
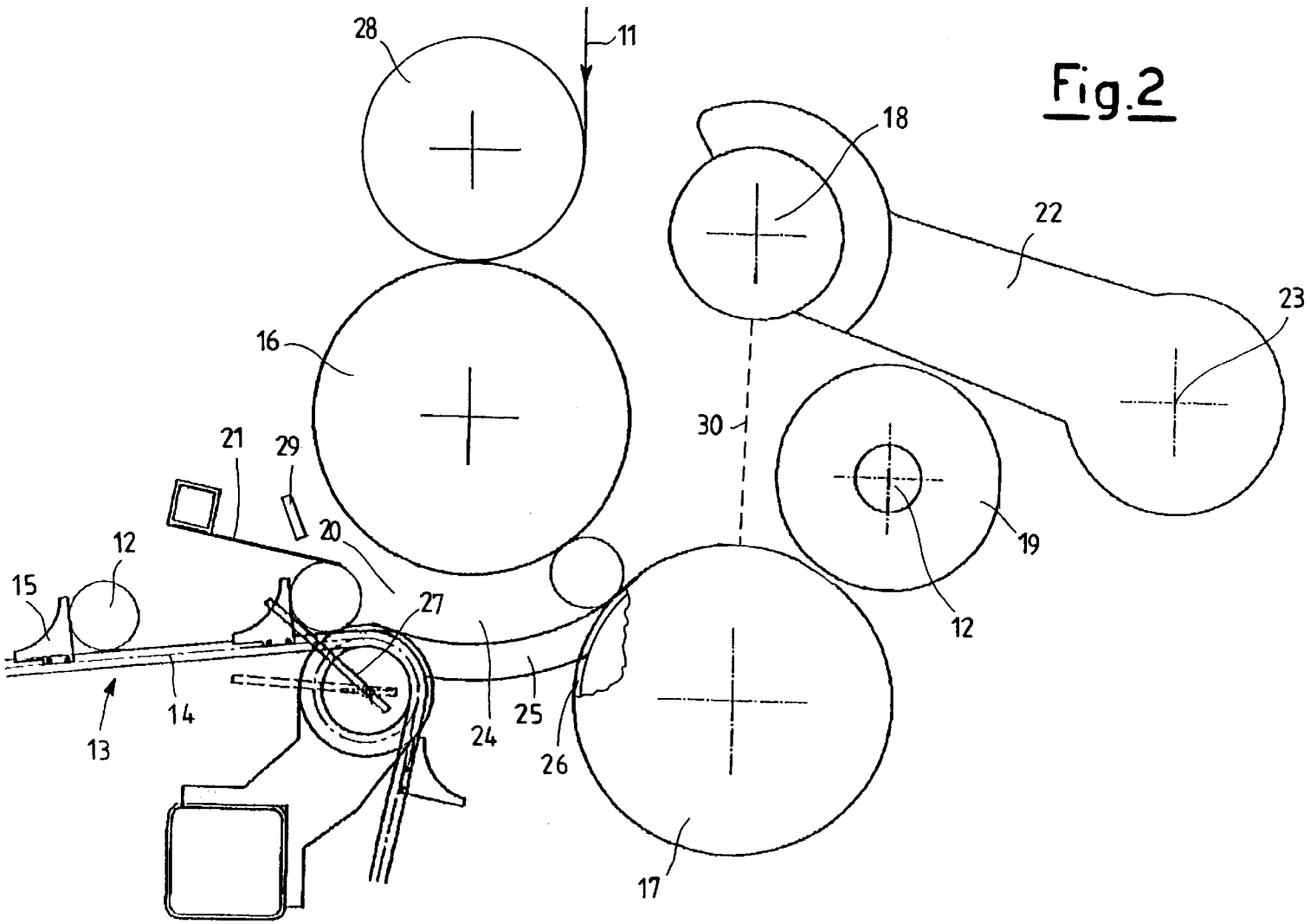
FIG. 2 is a side elevation view similar to that of FIG. 1 in a subsequent operating step of the device.

FIG. 2 shows a different step of operation of the device, in which the finished roll or log 19 has been ejected from the outlet gap 30 provided between the bottom roller 17 and the third roller, or pressure roller, 18.

In the figure, the core 12 has moved almost to the end of the channel 24, with the leading end of the paper 11 wound on it, and is ready to pass between the three rollers 16, 17 and 18 so that winding of a new roll can be carried out. Furthermore, a new core 12 has already been brought by a pusher 15 up to the intake gap 20, ready to be inserted into the channel.

The foregoing makes it possible to eliminate the means of interruption of the ribbon-like material envisaged in the prior art, so simplifying the device considerably.

The particular structure of the device of the present invention, when incorporated into a machine designed for making rolls of paper, as has been said previously, makes it possible to have maximum functionality with minimum presence of working parts, thus accelerating the introduction of the cores up to a number that is twice the number currently introduced, and hence an important increase in the production of logs per unit time can be achieved.

It is evident that the example of embodiment illustrated is only one of the possible embodiments. It may be understood that further examples of embodiments may be devised, all falling within the same innovative idea of the present invention.

What is claimed is:

1. A re-reeling device for forming a roll of paper in a re-reeling machine comprising, on a frame, three rollers (16, 17, 18) having mutually parallel axes that are perpendicular to the direction of feed of paper (11), wherein two winding rollers, a bottom winding roller (17) and a top winding roller (16), supported on said frame, co-operate with a pressure inducing roller (18) which maintains pressure on a roll of paper or log being formed, said pressure roller (18) supported by a pair of arms (22) which oscillate with respect to said frame, wherein cores (12), for said rolls, being fed in succession by pusher assembly (13), said cores (12) being introduced into a calibrated channel (24) located underneath said top winding roller (16), said paper (11) being wound on said top winding roller (16) and onto said cores (12), said finished roll or log (19) exiting an outlet aperture or gap between said bottom winding roller (17) and said pressure inducing roller (18) further comprising a deviating roller (28) abutting said top winding roller (16), said deviating roller (28) maintaining said paper (11) stretched, thereby preventing said paper (11) from moving backwards, said paper (11) being torn by an acceleration of said pressure roller (18) followed by attachment of said paper (11) to a second core (12) passing through said calibrated channel (24).

2. The device according to claim 1, wherein said calibrated channel (24) comprises curved elements (25) underneath said top winding roller (16).

3. The device according to claim 2, wherein said curved elements (25) are set alongside one another and designed to be inserted, at least partially by means of their ends, within grooves (26) in said bottom winding roller (17).

4. The device according to claim 1, wherein an intake gap (20) in said channel (24) comprises a pusher (27) that co-operates to insert one core after another core (12) into said channel (24).

5. The device according to claim 4, wherein said pusher (27) is selected from the group consisting of rotating or oscillating pushers.

6. The device according to claim 1, wherein an intake gap (20) in said channel (24) comprises a dispensing element for dispensing adhesive (29).

7. The device according to claim 1, wherein an intake gap (20) in said channel (24), comprises a compliant blocking element (21) acting on a core (12) carried by a pusher (15) of said pusher assembly (13).

* * * * *